US005743790A

United States Patent [19]

Trahan

[11] Patent Number: 5,743,790

[45] Date of Patent: *Apr. 28, 1998

[54] VIBRATING ABRASIVE CLEANING APPARATUS AND METHOD

[75] Inventor: Joe O. Trahan, Lafayette, La.

[73] Assignee: Drilltech Technologies, Inc., Houston, Tex.

[ * ] Notice: The term of this patent shall not extend beyond the expiration date of Pat. No. 5,460,566.

[21] Appl. No.: 507,635

[22] Filed: Jul. 25, 1995

Related U.S. Application Data

[63] Continuation of Ser. No. 16,724, Feb. 11, 1993, Pat. No. 5,460,566.

[51] Int. Cl.[6] ..... B24B 31/00

[52] U.S. Cl. ..... 451/326; 451/32; 451/35; 451/74; 451/104; 451/328; 451/330

[58] Field of Search ..... 451/74, 113, 104, 451/106, 107, 326, 327, 328, 329, 330, 32, 34, 35, 36

[56] References Cited

U.S. PATENT DOCUMENTS

| | | | |
|---|---|---|---|
| 949,709 | 2/1910 | Kunkel . | |
| 2,222,777 | 2/1940 | Linke . | |
| 3,161,997 | 12/1964 | Balz | 451/35 |
| 3,173,664 | 3/1965 | Isaacson et al. . | |
| 3,353,796 | 11/1967 | Roberts . | |
| 3,413,764 | 12/1968 | Kunkle . | |
| 3,637,190 | 1/1972 | Isaacson . | |
| 4,569,156 | 2/1986 | Yoder | 451/326 |
| 5,460,566 | 10/1995 | Trahan | 451/326 |

*Primary Examiner*—Eileen P. Morgan
*Attorney, Agent, or Firm*—Browning Bushman

[57] ABSTRACT

This invention relates to a vibrating abrasive cleaning apparatus and method which is powered by a hydraulic drive motor mounted to a square tubing frame which is housed within an enclosure that is vibrated by an eccentric shaft assembly directly coupled to the hydraulic drive motor and square tubing frame. The container assembly is mounted on the rigid square tubing frame, on one side by compression springs, on the opposite side by tension springs. The compression springs and tension springs have a different spring rate which produces better rolling of the media and therefore, faster parts circulation and cleaning. To further give flexibility to the cleaning process the hydraulic power supply is equipped with the variable volume piston pump to give infinite speed settings. The eccentric shaft assembly with the eccentric weight positions set at different relative positions to one another gives the operator the ability to adjust the machine to produce optimum results with all parts, sizes, and weights. The entire vibration assembly sits on a base and has a lid operated by a cable and counterweight for ease in loading the container for oscillation of the parts.

5 Claims, 5 Drawing Sheets

VIBRATING ABRASIVE CLEANING APPARATUS AND METHOD

This is a continuation of application Ser. No. 08/016,724, filed on Feb. 11, 1993 now U.S. Pat. No. 5,460,566.

FIELD OF THE INVENTION

This invention relates to a new and improved vibrating abrasive cleaning apparatus and method. More specifically, this invention relates to the implementation of an improved vibrating abrasive cleaning apparatus which implements an environmentally sound and self contained solvent "flush" system that filters and recirculates the cleaning solvent, used to separate the sediment and debris from the articles to be cleaned, into a angularly oriented container for housing the articles, wherein the angle of the container provides for better oscillation and cleaning of the articles contained therein and ease of access. The solvent in the container passes from the container into a holding reservoir and into an improved drainage assembly. The solvent then passes through an improved filter assembly which contains a sediment filter and a triformed filter. The filtered fluid then is recirculated back into the system. This invention further relates to a new and improved square tubing frame which supports the increased oscillation and rpm's of the eccentric shaft and weight assembly which contains additional counterweights for increased oscillation and productivity.

BACKGROUND ART

Many advances have been made in the field of vibratory devices used for cleaning articles. However, increased environmental concerns have lead to the awareness of employing a device or method capable of cleaning an article in a combined solid and fluid mixture, wherein the residue is not discarded and will be environmentally reprocessed through the system. Further developments in vibratory devices have lead to the concern for enhanced productivity through technological breakthroughs in the oscillation process. Consequently, the advances and developments require one of ordinary skill in the art to discern between the environmental statutory requirements, commercial desires and productivity. Conventional vibrating and abrasive cleaning apparatus have failed to address environmental concerns by dumping the waste material that is cleaned or removed from the articles. Further, conventional vibrating and abrasive cleaning apparatus have not addressed, nor met, the desired increased productivity demands made by the commercial industry.

Applicant's disclosure on Mar. 15, 1992, further demonstrates the present invention's improvements needed to meet the environmental and commercial concerns in the area of vibrating and abrasive cleaning apparatus. Applicant's disclosure comprised a vibrating and abrasive cleaning apparatus for cleaning articles through oscillation, and provided a refiltration process of circulating the cleaning solvent through a series of sedimentary and triformed filters, however, failed to address productivity concerns. Specifically, applicant's disclosure did not address the improvements as claimed and described herein such as the use of square tubing to house an angularly disposed container which provided increased stability, volumetric capacity, and better rolling of the media and solids about the container. Further, applicant's previous disclosure did not address the improved drainage system of the present invention which incorporates a mating, interchangeable, port assembly allowing the removal of the housing and square tubing frame assembly from the drainage system. Additionally, applicant's previous disclosure did not incorporate the addition of counterweights on the eccentric shaft assembly to improve the part rotation from 12 seconds/cycle to 8 seconds/cycle. Applicant's previous disclosure also did not incorporate clevis pins and cotter pins used to secure all vibration tension springs.

Thus, applicant's previous disclosure and conventional vibrating and abrasive cleaning apparatus failed to address the environmental and commercial concerns for an interchangeable and closed solvent circulation/filtration system and enhanced oscillation means for reduced cleaning time.

Consequently, it is a primary object of the applicant's invention to provide an environmentally, self-contained, solvent circulation/filtration system incorporating an interchangeable, mating, drainage port assembly for removal from the square tubing frame and housing, and improved oscillation means.

It is a further object of the invention to provide a power source for oscillation of the eccentric shaft assembly which comprises a primary electrical motor powering a hydraulic pump for the solvent and secondary hydraulic motor for oscillation of the eccentric shaft assembly.

It is a further object of the invention to provide a secondary electrical motor as an alternative source of power for smaller vibrating and abrasive cleaning apparatus.

It is a further object of the present invention to provide a square tubing frame for increased support and stability of the housing and container during oscillation and drainage.

It is a further object of the present invention to implement clevis bolts and cotter pins instead of hexagonal nuts to secure all vibration tension springs, thus facilitating better stability during oscillation, and enhanced productivity.

It is a further object of the present invention to provide an improved oscillation means comprising a primary power source and a secondary hydraulic power source driven by the primary power source for facilitating oscillation and circulation of excess solvent and debris within the container, and an eccentric shaft assembly connected to the secondary power source and square tubing frame to further facilitate oscillation of the container on the frame.

It is a further object of the present invention to increase the number of counterweights on the eccentric shaft assembly to improve the parts per rotation of articles in the container, thus improving productivity.

It is a further object of the present invention to further enhance oscillation performance and productivity through the implementation of variable spring rates between the compression and tension springs connected between the container and the frame.

It is a further object of the present invention to provide a variable volume piston pump on the secondary power source to permit infinite speed settings.

It is a further object of the present invention to provide an improved drainage means comprising an interchangeable, mating, port assembly connected to a fluid reservoir.

It is a further object of the present invention to provide an environmentally contained solvent filtration/circulation system allowing the debris and solvent to exit the container into the solvent filtration system to separate the debris and recirculate the cleaned solvent back into the container.

It is a further object of the present invention to angularly orient the container mounted on the square tubing frame, within the housing, to further enhance productivity by enabling ease of access to the container and enhanced rotation of the articles, solvent and media about the container.

It is a further object of the present invention to implement a unitary interior liner of polyurethane for the interior lining of the container.

The above as well as additional objects, features, and advantages of the invention will become apparent in the following description.

SPECIFIC DESCRIPTION OF THE DRAWINGS

Figure 1:
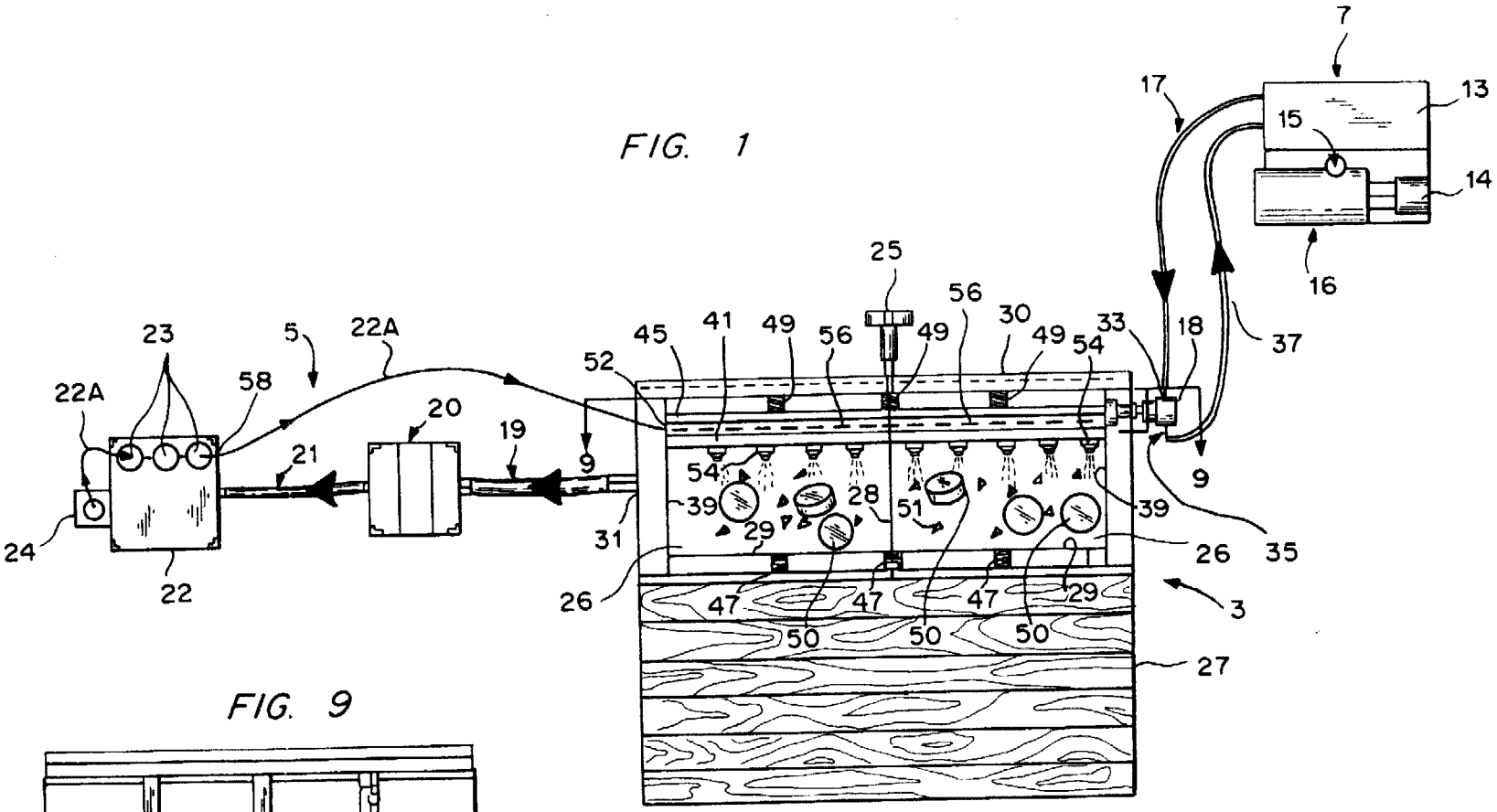
FIG. 1 is a top view of the vibrating abrasive cleaning apparatus and corresponding hydraulic power source and filtration system.

FIG. 1 generally depicts a power source 7, base support and vibrating abrasive cleaning apparatus 3, and filter assembly 5.

Figure 2:
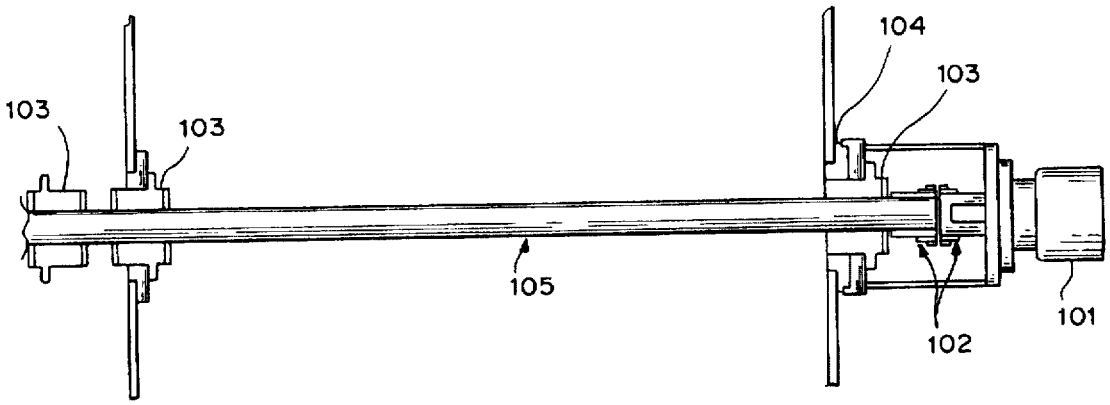
FIG. 2 is a cross-sectional view of the eccentric shaft assembly.

As seen from FIG. 1, the abrasive vibrating cleaning apparatus is primarily powered by a power source 7 which is powered by an electric motor 16 which in turn powers the hydraulic pump 14 sending the hydraulic fluid in the hydraulic reservoir 13 into the hydraulic hose 17, which in turn enters the hydraulic motor 18 at 33 to power the eccentric shaft assembly shown in FIG. 2. Preferably, the hydraulic motor 18, contains a variable volume piston pump capable of infinite speed settings. Consequently, the return hydraulic fluid exits the hydraulic motor 18 at 35 and enters the hydraulic hose 37 to return to the hydraulic return filter 15 for recirculation.

Once the hydraulic fluid enters the hydraulic motor 18 at 33, the eccentric shaft assembly is engaged to initiate oscillation and the user then may fill the container 26 with the articles, such as thread protectors 50 to be cleaned, solvent, and abrasive media, such as ceramic chips 51, that combine with the solvent to abrasively clean the articles during the oscillation process.

The contaminated solvent used to clean the articles drains through a drainage assembly depicted in FIG. 3, exits at 31, and is then recirculated and filtered as described hereinbelow, and the clean solvent passes through return line 22A into the manifold system 56 at 52 and out through 9 injection nozzles 54 used to spray the solvent onto the articles and into the container 26 during the oscillation period. The recirculation and filtration process is continuously repeated.

Counterweight, 25 is used to raise the lid (not shown) to open the container 26 to deposit the articles therein. The container is embodied in a square tubing frame consisting of tubing members 29, 39, 41 and 28. Tubing member 28 extends vertically, thus disecting the bottom of the square tubing frame promoting better support and stability for the vibrating abrasive cleaning apparatus. Further, square tubing member 41 acts to stabilize the container and runner 45 secures tension springs 49 in place which stabilize the container and provide oscillation in combination with compression springs 47 which also act to hold the container in place. Square tubing member 30 also acts to stabilize the container and provide the rear surface of the vibrating abrasive cleaning apparatus.

It is the preferred embodiment to provide a hydraulic power source 18 to generate the power necessary to turn the eccentric shaft of FIG. 2 thus, providing oscillation and movement of the container in connection with springs 49 and 47. It is an alternative embodiment to provide an electrical power source at 18 for smaller vibrating abrasive cleaning apparatus.

After the oscillation period has ended thus, cleaning the thread protectors 50 in the container 26, the excess debris and solvent pass through the container into a hydraulic drain manifold (not shown) and exits the vibrating abrasive cleaning apparatus at 31. The solvent and debris then pass into the hydraulic hose 19 which in turn pass through a sediment tank 20 which filters solids from the solvent. Thereafter, the contaminated solvent leaves the sediment tank 20, into a hydraulic hose 21, and into the sediment filter assembly 22 which forces the solvent into a submersible centrifugal pump 24 that pumps the contaminated solvent into return line 22A and then through a series of triformed filters 23 that exit at 58 and return the solvent through line 22A into the nozzle manifold system 56 for recirculation of the clean solvent into the container 26 through 9 injection nozzles 54 into the container. Thus, this is an environmentally closed system for recirculation of the solvent.

Figure 9:
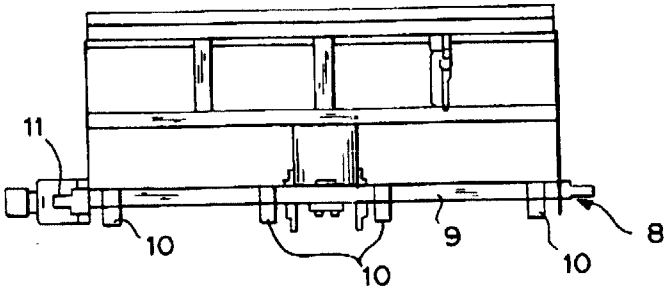
FIG. 9 is a cross-sectional view of 9—9 of FIG. 1.

FIG. 9, Section 9—9 of FIG. 1, depicts a bearing 8 securing eccentric shaft 9 with counterweights 10 that provide the oscillation and vibration necessary for abrasive cleaning once the hydraulic motor 18 powers the eccentric shaft assembly. Hydraulic motor 18 is secured by an adapter 11 to the side face of the vibrating abrasive cleaning apparatus 3 in FIG. 1.

Figure 1A:
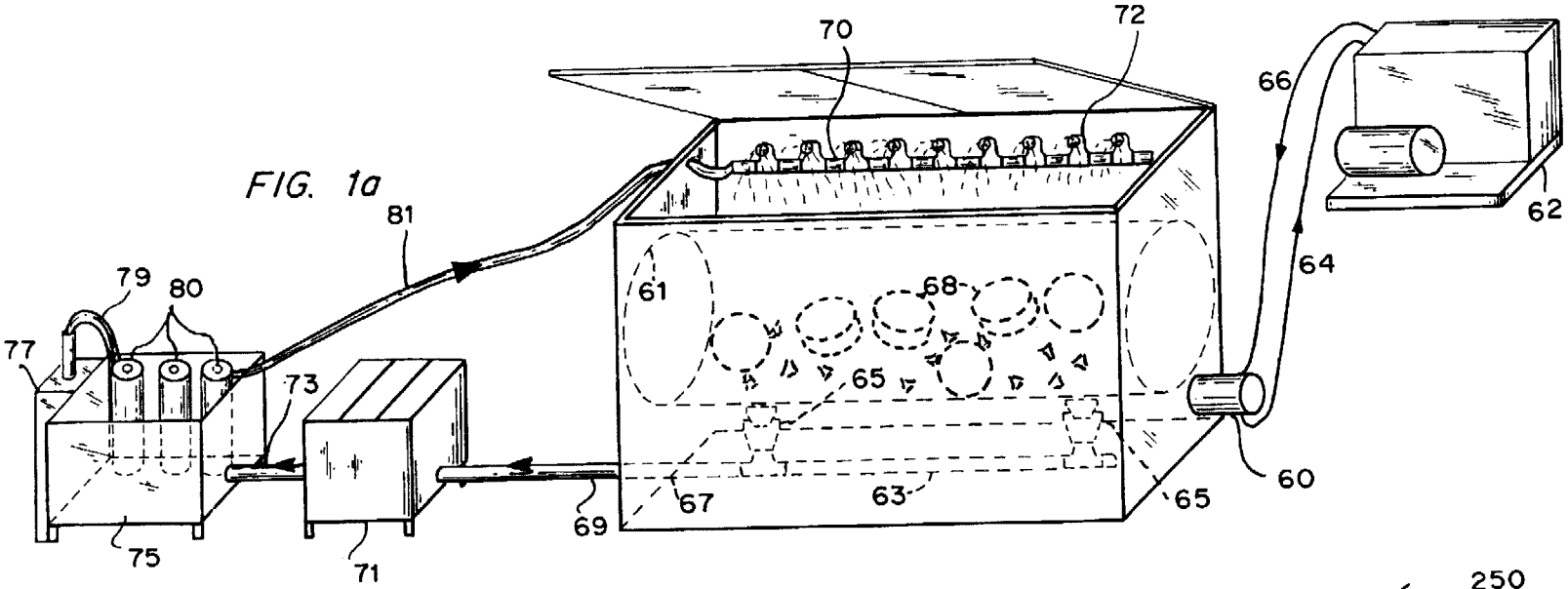
FIG. 1A is a projected view of the vibrating abrasive cleaning apparatus and corresponding hydraulic power source and filtration system.

FIG. 1A is a projected view of the entire vibrating abrasive cleaning apparatus demonstrating the hydraulic fluid and solvent flow direction. As seen in FIG. 1A, the hydraulic power supply 62 pumps the hydraulic fluid through line 66 into hydraulic drive motor 60 to power the eccentric shaft and weight assembly. The return hydraulic fluid passes out through line 64 back into the hydraulic power supply 62. Once oscillation and vibration begin to clean the articles, thread protectors 68 in the container 61, the nozzle manifold 70 projects the solvent through 9 injection nozzles 72 into the container 61 during the oscillation period. During and after oscillation, the debris and contaminated solvent from the thread protectors pass through the drainage assembly 65 and into the hydraulic drain manifold 63 below the container 61. The contaminated solvent then exits the vibrating abrasive cleaning apparatus at 67 through hose 69 and into the sediment tank 71 for filtration of the solids from the solvent. The solvent then passes through line 73 into a filtration tank 75 which contains a submersible centrifugal pump 77 to inject the contaminated solvent through hose 79 into a triformed filter cartridge 80 which exits as clean solvent through return hose 81 and back into the system through the nozzle manifold at 70 and 9 injection nozzles 72. The number of injection nozzles used on the nozzle manifold naturally depends on the size of the vibrating abrasive cleaning apparatus.

FIG. 2 is an exploded view of the eccentric shaft assembly depicting a hydraulic motor 101 which powers an eccentric shaft 105 which is secured by an engagement coupling 102 allowing for even rotation of the eccentric shaft. Bearing housing 103 further secures said eccentric shaft together with a welded plate 104 which also secures the square tubing frame to the container.

Figure 3A:
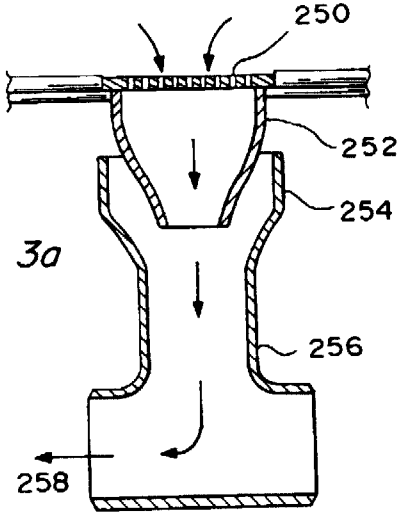
FIG. 3A is an exploded view of the mating, interchangeable, port assembly revealed in FIG. 3.
Figure 3:
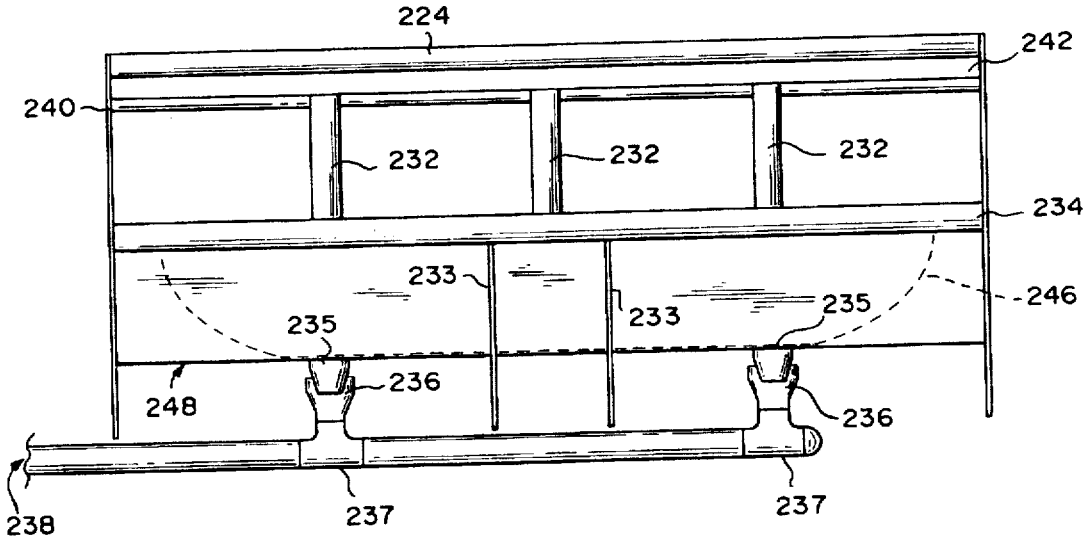
FIG. 3 is a cross-sectional view of the drainage assembly.

FIG. 3 shows the drainage assembly wherein structural framing members 232 are fabricated of 3 by 3 by ¼ inch square tubing to rigidly support the container once oscillation begins and is further supported by square tubing members 234,242 and 240. Thus, the top of the vibrating abrasive cleaning apparatus 244 rests on and is supported by square tubing member 242. Fluid nozzle openings 235 allow the solvent to exit the container 246 and enter the ports 236 and down into tubing 237 which exits at 238 into the sediment tank. Steel supports 233 act to secure the square tubing members 234,242, and 240 in place and in connection with the basin 248 from which the drainage assembly beginning with ports 236 and tubing 237 may be easily and temporarily removed for such necessities as cleaning. It is the preferred embodiment to perforate the nozzle openings 235 wherein the nozzles comprise a 4 by 1½ inch concentric nozzle type reducer, interchangeable with a female adapted 5 by 3 inch port type reducer 236 which is welded to a 3 inch schedule 40 tubing tee 237 and duct 238.

FIG. 3A generally depicts the solvent's path once the solvent exits the container 246 in FIG. 3 and passes through perforated nozzle openings 250 through the 4 by 1½ inch concentric nozzle type reducer into the 5 by 3 inch port type reducer 254 and into the schedule 40 tubing tee 256. Thus, the contaminated solvent then passes into duct 258 and onto the filtration process.

Figure 4:
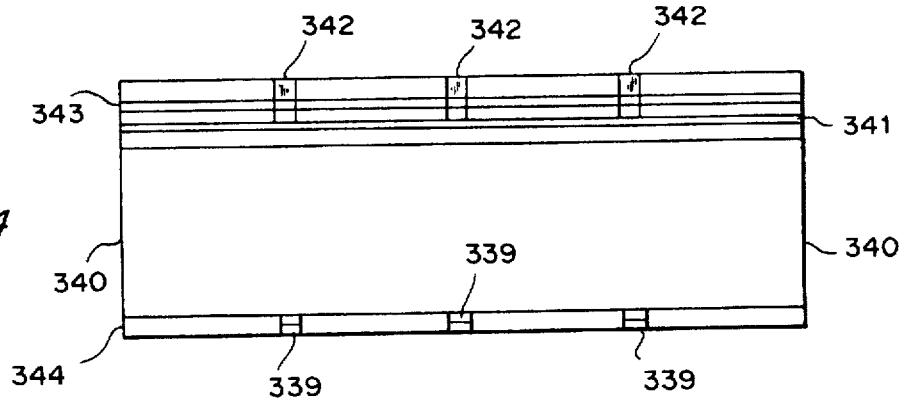
FIG. 4 is a cross-sectional top view of the frame assembly.

FIG. 4 generally depicts a cross-sectional top view of the frame assembly where said compression springs are held in place at holes 339 on the front square tubing member 344 which is attached by steel plates 340 to runners 341 and 343 which contain perforated holes to hold the tension springs in place at 342.

Figure 5:
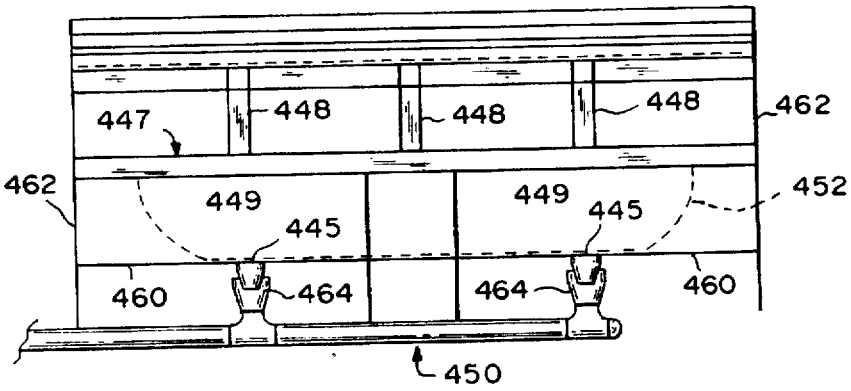
FIG. 5 is a front view of the container assembly.

FIG. 5 is a front view of the container assembly showing a preferred embodiment of 3 by 3 by ¼ inch square tubing frame members 447 and 448 welded together to support the torque of the container during oscillation. Further, the container 452 is housed by ½ inch steel plates 460 and 462 which surround the frame members and provide an enclosure 449 creating a reservoir for the container. Drainage assembly 450 is interchangeable with the housing plate 460 by means of mating male nozzle openings 445 that adapt to and interchangeably fit within ports 464.

Thus, FIGS. 4 and 5 demonstrate the structural components of the square tubing frame assembly and how they interact with the container and drainage assemblies.

Figure 6:
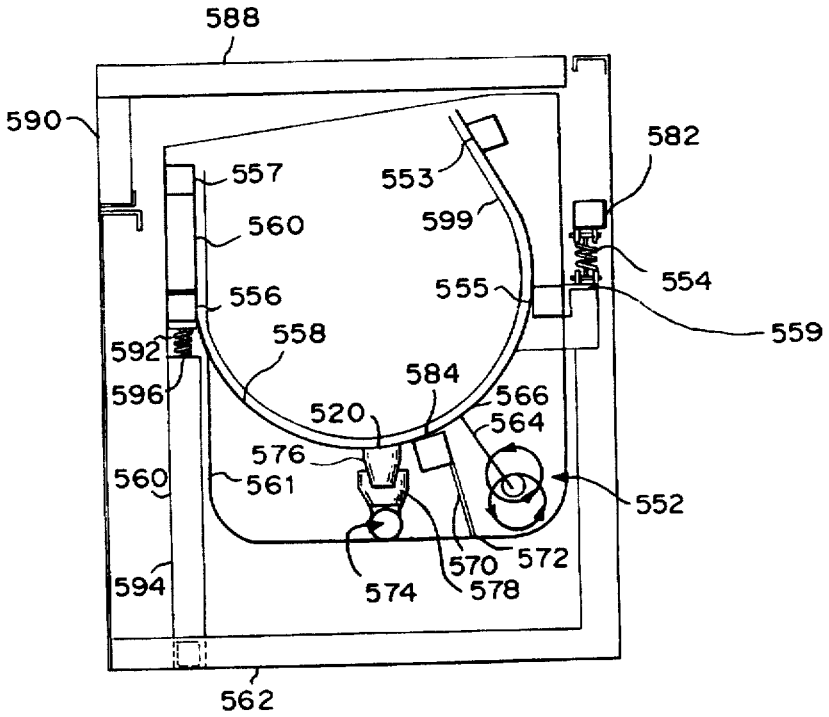
FIG. 6 is a cross-sectional view of the container and frame assembly.

FIG. 6 is a cross-sectional view of the container and frame assembly wherein a container 558 is offset from a drainage housing 561, which is supported and held in place by square tubing members 560,562, and 582. Container 558 has perforated openings at 520 to allow the debris and solvent to enter and drain into the drainage nozzle 576, port opening 578, and tubing duct 574. The container 558 is supported by 5 welded square tubing supports at 553, 555, 584, 556 and 557 which operate freely in movement by a series of compression and tension springs which are further depicted in FIGS. 7 and 8. The container is oscillated by engaging the eccentric shaft assembly and counterweights 552 which are connected to the container 558 at 566 by rod 564. Support member 559 acts to support one end of the tension spring 554 which extends vertically upward and terminates at joint 582 which also supports the tension spring. The container is angularly and vertically disposed from the housing reservoir 561 to allow the eccentric shaft assembly 552 free oscillation and movement of its counterweights to vibrate the entire container assembly thus, allowing better oscillation, decreased cleaning time, and ease of access. Square tubing support 584 is welded to the container 558 and is secured to the housing 561 at 572 by a metal rod 570. The entire housing 561 and container assembly 558 are secured within the vibrating abrasive cleaning apparatus by square tubing members 553, 555, 584, 556, and 557 and thus, are housed by square tubing member 562, 590, and lid 588. Support member 559 is welded to square tubing member 555, however, acts independent and freely to allow tension spring 554 to dampen the container's 558 movement in conjunction with compression spring 592 during the oscillation period. The compression spring 592 is secured to square tubing member 594 at 596. A ½ inch polyurethane liner 599 is used to line the container and allows freedom of the articles and media to rotate with minimal friction against the container's interior walls. The liner 599 has an expanded metal back and possesses a preferred durometer rating of 90.

Figure 7:
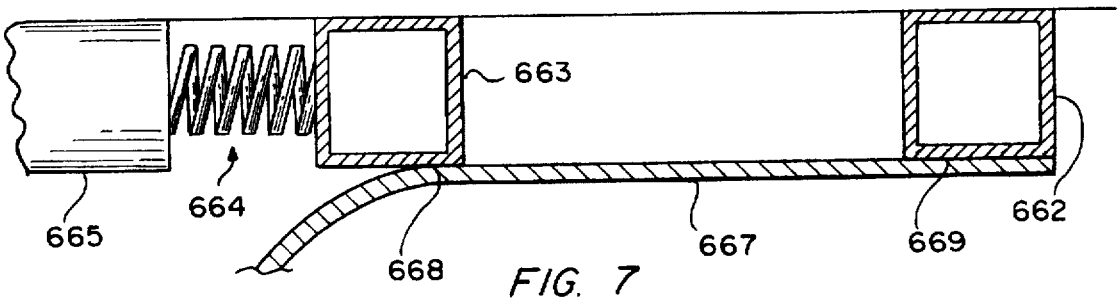
FIG. 7 is an exploded cross-sectional view of the compression spring assembly.

FIG. 7 is an exploded view of the compression spring assembly of FIG. 6 wherein square tubing joint 662 is vertically disposed above square tubing joint 663. Square tubing joint 663 provides the uppermost support for the compression spring 664 which terminates in compression at the most distal upper portion of the square tubing frame at 665. The container 667 is welded to square tubing joint 662 at 669 and square tubing joint 663 at 668 to enable the container to freely move during the oscillation period.

Figure 8:
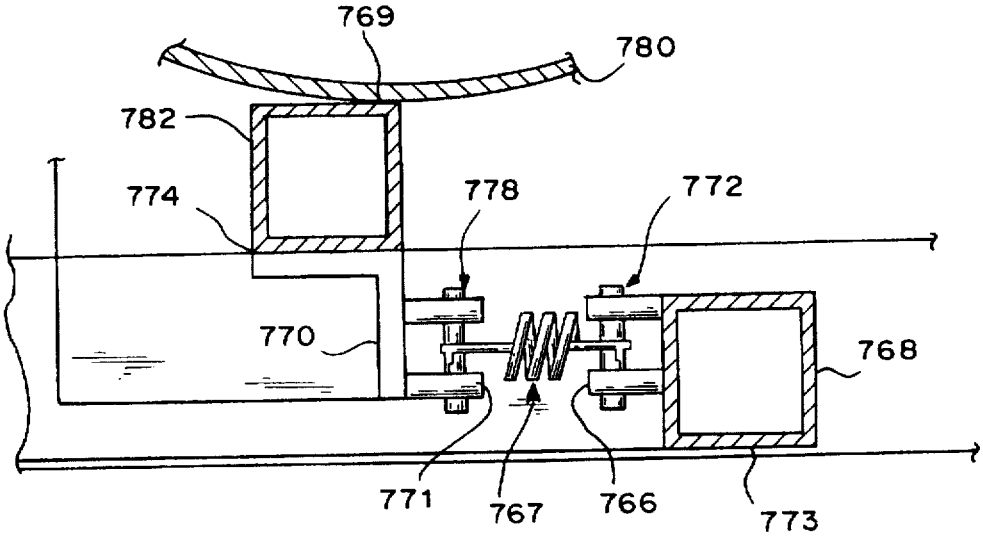
FIG. 8 is an exploded cross-sectional view of the tension spring assembly.

FIG. 8 further depicts the tension spring assembly of FIG. 6 wherein square tubing joint 768 is attached to the interior of the vibrating abrasive cleaning apparatus at 773 and secures vertical support member 766 which secures bolt 772. Tension spring 767 is therefore, vertically disposed in tension between bolts 772 and 778, wherein the lowermost portion of the tension spring secured to bolt 778 is also secured by a vertical support member 771 attached to an L shaped plate 770 which freely moves the container 780. Support members 766 and 771 are preferably clevis type supports, wherein bolts 778 and 772 are secured therein by cotter type pins (not shown). The container 780 is thus, welded to square tubing joint 782 at 769. Square tubing joint 782 is also attached to L-shaped plate 770 at 774.

It is the preferred embodiment to provide variable spring rates between the compression springs and tension springs embodied in FIGS. 7 and 8.

Although the invention has been described with reference to a specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A method for clearring articles which comprises:

(a) placing articles, an abrasive media and cleaning fluid in a container angularly mounted on a frame by a plurality of opposing parallel compression and tension springs for oscillation of the container;

(b) engaging a primary power source for engaging a secondary hydraulic power source;

(c) pumping said cleaning fluid through a filter system;

(d) injecting said cleaning fluid into the container;

(e) oscillating said container; and (f) recirculating said cleaning fluid through a series of filters back into the container through an injection means.

2. An apparatus for cleaning articles in a fluid and oscillating medium, which comprises:

(a) a frame containing a plurality of integrally connected unitary components of square tubing for facilitating stability of a container, oscillating means and drainage means;

(b) a container angularly mounted on the frame by means of a plurality of opposing parallel compression and tension springs having differing spring rates for enhancing oscillation of the container which holds said articles;

(c) a means for injecting a cleaning fluid into the container for cleaning the articles contained in the container, said injection means having an intake manifold and a plurality of injection nozzles horizontally displaced on the intake manifold and over the container for injection of the cleaning fluid into the container;

(d) a means for oscillating the container within the frame wherein said oscillating means comprising:

i. a primary power source;

ii. a secondary hydraulic power source driven by the primary power source for enabling oscillations;

iii. an eccentric shaft assembly having a plurality of counterweights integrally connected thereto and connected to the secondary power source and frame to permit eccentric movement of the shaft assembly and counterweights resulting in oscillation of the container on the frame; and iv. a variable volume piston pump integrally connected to said secondary power source for enabling an infinite number of speed settings;

(e) a means for draining excess debris and cleaning fluid from the articles in container once oscillation begins wherein said drainage means comprises:

i a reservoir in the container;

ii. an opening in the container below the reservoir;

iii. a nozzle attached to the container below the reservoir and opening;

iv. a port releasably engaged with the nozzle in fluid communication with the container and the filter means; and (f) a means for filtering and recirculating the cleaning fluid from the solid debris back into the container, said filter means having a duct leading from the draining means to a first filter and a duct leading from the first filter to a second filter wherein said second filter contains a circulation pump assembly to circulate the cleaning fluid back into the container through the injection nozzle means.

3. An apparatus for cleaning articles in a fluid and oscillating medium, which comprises:

(a) a frame;

(b) a container angularly mounted on the frame by means of a plurality of opposing parallel compression and tension springs having different spring rates for enhanced oscillation of the container which holds said articles;

(c) a means for injecting a cleaning fluid into the container for cleaning the articles contained in the container;

(d) a means for oscillating the container within the frame;

(e) a means for draining excess debris and cleaning fluid from the articles in the container once oscillation begins, said drainage means comprising:

i a reservoir in the container;

ii. an opening in the container below the reservoir;

iii. a nozzle attached to the container below the reservoir and opening;

iv. a port releasably engaged with the nozzle in fluid communication with the container and the filter means; and (f) a means for filtering and recirculating the cleaning fluid from the solid debris back into the container.

4. Apparatus for cleaning articles in a fluid and oscillating medium, which comprises:

(a) a frame;

(b) a container angularly mounted on the frame by means of a plurality of opposing parallel compression and tension springs having differing spring rates for enhanced oscillation of the container which holds said articles;

(c) a means for injecting a cleaning fluid into the container for cleaning the articles contained in the container;

(d) a means for oscillating the container within the frame;

(e) a means for draining excess debris and cleaning fluid from the articles in the container once oscillation begins; and (f) a means for filtering and recirculating the cleaning fluid from the solid debris back into the container, said filter means comprising a series of filters.

5. An apparatus for cleaning articles in a fluid and oscillating medium which comprises:

(a) a frame;

(b) a container angularly mounted on the frame by a plurality of opposing parallel compression and tension springs for oscillation of the container which holds said articles;

(c) a means for injecting a cleaning fluid into the container for cleaning the articles contained in the container;

(d) a means for oscillating the container within the frame;

(e) a means for draining excess debris and cleaning fluid from the articles in the container once oscillation begins; and (f) a means for filtering and recirculating the cleaning fluid from the solid debris back into the container.

* * * * *